US012402708B2

(12) United States Patent
Wong-Putnam et al.

(10) Patent No.: US 12,402,708 B2
(45) Date of Patent: Sep. 2, 2025

(54) SHOCK ABSORBING INSERTS FOR COSMETIC COMPACTS

(71) Applicant: ELC Management LLC, Melville, NY (US)

(72) Inventors: Pamela Wong-Putnam, Greenlawn, NY (US); Gianluca Mattaroccia, Sunnyside, NY (US); Steven Shannon, Roselle, IL (US); Jian Zhou, Buffalo Grove, IL (US)

(73) Assignee: ELC Management LLC, Melville, NY (US)

( * ) Notice: Subject to any disclaimer, the term of this patent is extended or adjusted under 35 U.S.C. 154(b) by 523 days.

(21) Appl. No.: 17/652,505

(22) Filed: Feb. 25, 2022

(65) Prior Publication Data

US 2023/0270230 A1 Aug. 31, 2023

(51) Int. Cl.
*A45D 33/00* (2006.01)

(52) U.S. Cl.
CPC ..... *A45D 33/003* (2013.01)

(58) Field of Classification Search
CPC ..... A45D 2033/001; A45D 33/00; A45D 33/003; A45D 33/006
See application file for complete search history.

(56) References Cited

U.S. PATENT DOCUMENTS 5,655,553 A * 8/1997 Giese ..... A45D 40/24 132/303
6,536,447 B1 * 3/2003 Fioravanti ..... A45D 34/00 132/299
2008/0011320 A1 * 1/2008 Bouix ..... A45D 33/006 132/293
2019/0037998 A1 2/2019 Greenfield et al.
2019/0059557 A1 * 2/2019 Kehoe ..... A45D 40/24
2021/0289914 A1 9/2021 Hwang et al.
2021/0289915 A1 9/2021 Hwang et al.

FOREIGN PATENT DOCUMENTS

CN 211833263 U 11/2020
CN 213045846 U 4/2021
CN 213464117 U 6/2021
FR 3099035 A1 * 1/2021 ..... A45D 33/006
JP H09299138 A 11/1997
JP 2002223843 A 8/2002
(Continued)

OTHER PUBLICATIONS

Le Cudonnec, Jan. 29, 2021, English translation of FR 3099035 (Year: 2021).*

(Continued)

*Primary Examiner* — Edward Moran
*Assistant Examiner* — Sydney J Pulvidente
(74) *Attorney, Agent, or Firm* — Peter Giancana

(57) ABSTRACT

A compact case comprises a product palette configured with one or more product wells. The palette is connected to, and rests, on top of a shock absorbing insert, and both are located in the base of the compact. The shock absorbing insert is a flexible member comprised of one or more hubs from which one or more projections extend. The shock absorbing insert is able to absorb and dissipate energy during impact so that product in the product in the product wells is protected.

9 Claims, 8 Drawing Sheets

(56) References Cited

FOREIGN PATENT DOCUMENTS

| | | | |
|---|---|---|---|
| JP | 2004298257 | A | 10/2004 |
| JP | 2009148618 | A | 7/2009 |
| JP | 2010246890 | A | 11/2010 |
| JP | 2012125497 | A | 7/2012 |
| KR | 200354465 | Y1 | 6/2004 |
| TW | 201944934 | A | 12/2019 |
| WO | WO-2008/008682 | A2 | 1/2008 |

OTHER PUBLICATIONS

PCT International Search Report; International Application No. PCT/US2023/063073; Completion Date: Jun. 23, 2023; Mailing Date: Jun. 23, 2023.

PCT Written Opinion of the International Searching Authority; International Application No. PCT/US2023/063073; Completion Date: Jun. 23, 2023.

Taiwan Search Report from TW Application No. 112107057; Date: Oct. 3, 2023.

* cited by examiner

SHOCK ABSORBING INSERTS FOR COSMETIC COMPACTS

FIELD OF THE INVENTION

The present invention concerns improved compact containers, especially the types of compacts associated with cosmetic and personal care products.

BACKGROUND OF THE INVENTION

A cosmetic compact is a portable storage container for color makeup products, personal care products, and/or other articles such as implements for applying product. Typical products may be solid or semi-solid, such as pressed or cast powders, pastes, creams or products of a cake-like consistency. Cosmetic products that may be offered in compact cases include blush, eyeshadow, foundation, lip products, and others.

Compacts are versatile in that they are convenient and functional, while also being visually appealing. The latter is an important feature in a retail environment. Some common features of a cosmetic compact include a base, and a cover that closes the base to protect the contents of the base. Within the base are one or more compartments for holding one or more cosmetic products or related articles. Such product compartments may be implemented as a one or more plastic or metal pans, or as a platform that rests in the base. The cover may alternately assume opened and closed positions with respect to the base. The cooperation of the cover and base may include an airtight seal between the two, and a fastening mechanism that prevents accidental opening of the compact. The base and cover are generally the same overall shape; round, oval and rectangular being very common. Cosmetic compacts are usually sized to fit conveniently into a handbag, and held in the hand when in use. Also, it is quite common for the innerside of the cover to comprise a mirror that may used when the compact is in an opened position.

In commercial shipping and distribution, cosmetic compacts may be subjected to potentially damaging forces, such as vibration and sudden impact. Also, because compacts are intended to be carried by a consumer, they are subject jostling around in a handbag, or being dropped onto a hard surface. The compact is responsible for enduring this mistreatment while suffering little or no damage, as well as protecting the contents within. For this reason, compacts tend to be made of solid, impact resistant materials, like hard plastics and metal. But there is a tradeoff, in that the forces of impact and vibration tend to be transmitted through the compact and into the contents that the compact is supposed to protect. This is especially troublesome when the contents of the compact include one or more pressed powders which are stiff, and tend to respond to sudden shock or repeated vibration by cracking and crumbling. This is particularly true for higher quality pressed powders which are manufactured with less compression to provide a softer 'feel' to the user, and better product payoff onto the fingers or an applicator. If the compact cannot protect its contents, then the consumer is dissatisfied. Furthermore, the cracked or crumbled cosmetic may negatively impact the performance of the product. For example, crumbled product may load unevenly onto an applicator (e.g., a brush or a pad). This in turn may lead to an undesirable and unattractive distribution of product on the user's skin. While some efforts have been made to attenuate the destructive energy that reaches the product within a compact, improvements are still needed.

The following are a sample of efforts that have been made to address the foregoing concerns: US2021/0289914, US2021/0289915, US2019/037998, US2008/0011320, CN213464117U, CN213045846U, CN211833263U, TW201944934, TW1688351, JP2012125497, JP5722022, JP2010246890, JP2009148618, JP4950240, JP2004298257, JP4323196, JP2002223843, JP4683738, JPH09299138. None of these discloses a product palette in combination with a shock absorbing insert that will protect the contents of a compact, as disclosed herein.

Objectives of the Invention

A main object of the invention is to provide a product palette in combination with a shock absorbing insert for use in compact containers of the type described herein.

Another object of the invention is to provide a product palette in combination with a shock absorbing insert that will protect the contents of the compact by reducing or eliminating damage to the contents of the compact caused by miscellaneous impacts and vibration.

Another object of the invention is to provide improved cosmetic compacts for one or more pressed powder products, the improvement being realized in the degree of stress that the compacts can withstand without suffering damage to the pressed powder products.

Another object of the invention is to provide a product palette in combination with a shock absorbing insert that can be easily fitted to an existing compact case to reduce or eliminate damage to the contents of the compact.

SUMMARY OF THE INVENTION

The present invention comprises a product palette in combination with a shock absorbing insert. The palette comprises one or more product reservoirs or wells. The shock absorbing insert is a flexible member that can absorb and dissipate the energy of an impact or vibration. The present invention is also a compact case that comprises a base, a shock absorbing insert disposed in the base, a product palette that rests on top of the shock absorbing insert, and a cover that closes the base to protect the contents of the base. Separate features of the shock absorbing insert address side impact and bottom impact.

DETAILED DESCRIPTION OF THE INVENTION

Figure 1:
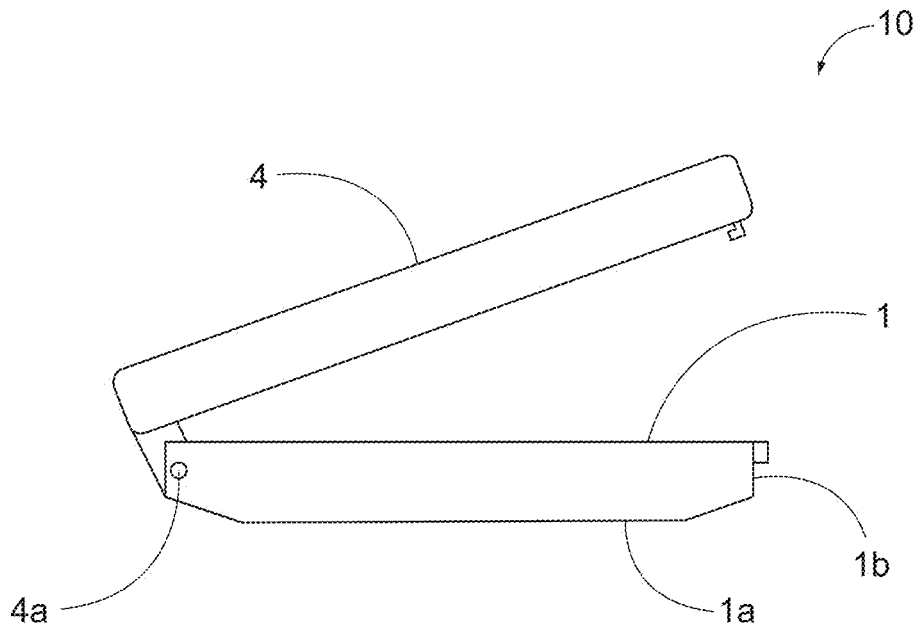
FIG. 1 depicts a conventional compact base and cover.

Throughout this specification, the terms "comprise," "comprises," "comprising" and the like shall consistently mean that a collection of objects may not be limited to those objects specifically recited.

A product palette in combination with a shock absorbing insert according to the present invention is intended to be used in containers, such as a compact for one or more cosmetic products. In the following description, the principles of the invention are embodied in a cosmetic compact container. However, it will be readily apparent that the invention is not limited to cosmetic compacts, and the principles of the invention may be embodied in other types of containers.

The most common compacts have lateral dimensions (i.e. width and depth, or diameter) that are greater than the height of the compact. This type of cosmetic compact is relatively flat and planar, and easy to describe in terms of the current invention. There is no industry definition, but in keeping with the idea of compact, it may be observed that many cosmetic compacts have a largest lateral dimension of about 30 mm to about 305 mm. Preferably, the largest lateral dimension is less than 305 mm, more preferably less than 150 mm, even more preferably less than 100 mm. For example, in a rectangular compact, the largest lateral dimension of the base refers to the longer side of the base. In a round compact, the largest lateral dimension of the base refers to the diameter of the base. In an oval compact, the largest lateral dimension of the base refers to the major axis of the base.

A main feature of the present invention is a product palette in combination with a shock absorbing insert. Following, we describe the use of this combination in a cosmetic compact case (10). Such a case typically comprises a base (1), a product palette (2) configured with one or more wells capable of retaining a product, a shock absorbing insert (3), and a cover (4).

The Base

Figure 2:
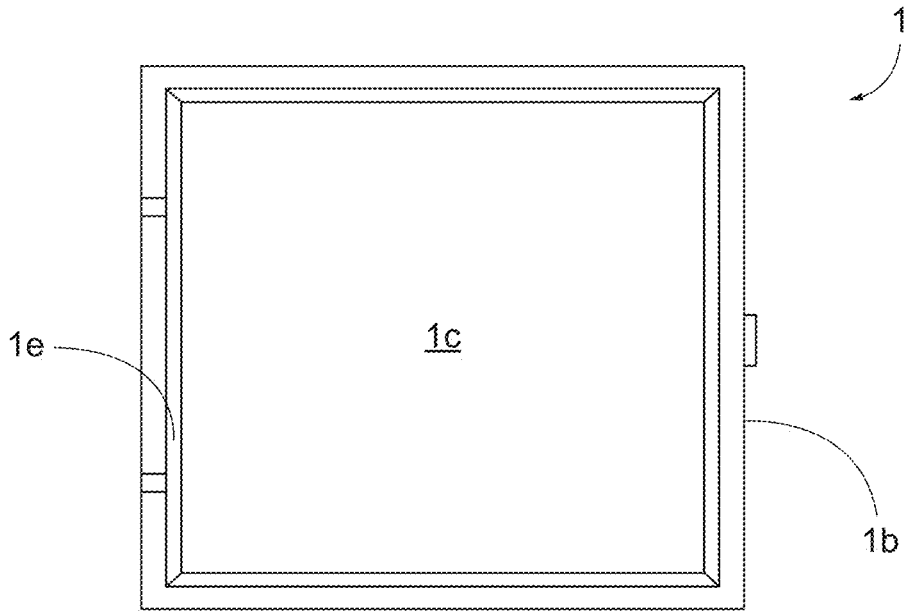
FIGS. 2 and 3 depict two embodiments of the base of a compact.
Figure 3:
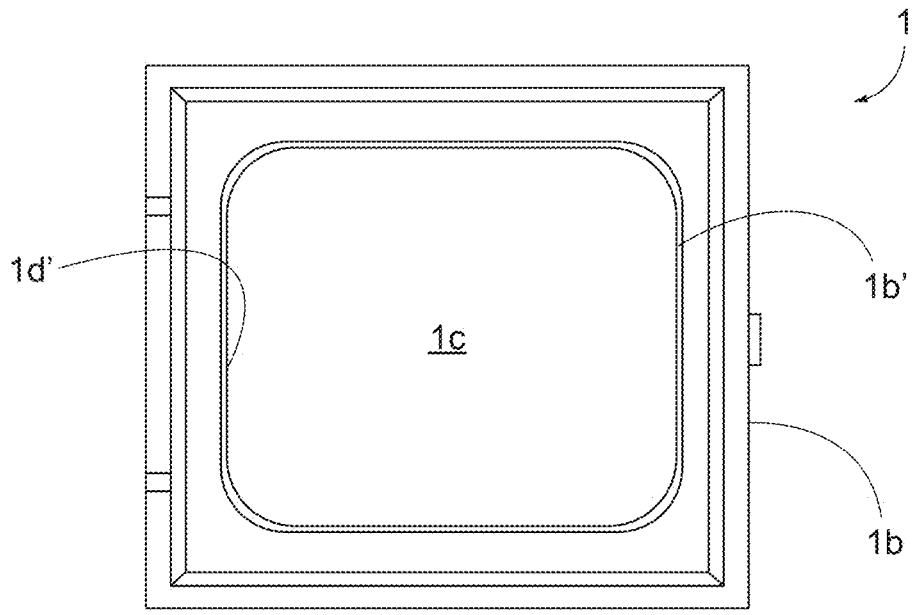

Referring to the embodiment shown in FIGS. 1-3, the base (1) of the compact (10) comprises a closed bottom (1*a*) that is bounded by a lateral wall (1*b*). An interior space (1*c*) is defined by the closed bottom of the compact and an inner surface. The inner surface may be the inner surface (1*d*) of the lateral wall (1*b*; see FIG. 6), or the inner surface (1*d*') of some secondary lateral wall (1*b*'; see FIG. 3). In the description that follows, we refer to the inner surface (1*d*) of the lateral wall (1*b*) for simplicity, but other inner surfaces will work as well. Examples of common shapes of the interior space include round, oval, square or rectangular, but this list is not exhaustive. The interior space is designed to house a product palette (2), and a shock absorbing insert (3).

The Cover

A cover (4) protects the contents of the interior space (1*c*) of the base (1). The cover is able to assume an opened position and a closed position with respect to the base (1). In the closed position the cover lays on top of the base, or perhaps, just inside the top of the base, and the contents of the base are not generally accessible. In this position, the cover protects the contents of the base, and reduces the occurrence of cosmetic dry-out and contamination. In the opened configuration, the cosmetic product housed in the base is generally accessible.

The cover may be detachably secured to the base via an interference or snap fit or threaded engagement, or via any other known means. In such cases, the compact (10) is opened by detaching the cover from the base. Alternatively, the cover may be secured to the base in a pivoting engagement, so that the cover is moveable with respect to the base between an opened position and a closed position. For example, the base-to-cover attachment may comprise a hinge (4*a*) that cooperatively joins the base (1) and cover (4), by any means known in the art. The range of motion of the cover relative to the base may be from 0° (closed position) to at least about 90° (opened position). To prevent the hinged cover from opening inadvertently, means for holding the cover in the closed position on the base may be provided. Examples known in the art include cooperating latching features or magnetic elements associated with the base and the cover. The base and cover will ordinarily be fashioned from one or more plastics, by any suitable means, but may also be metallic or a combination of materials chosen for an aesthetic effect. Compacts of this type are suitable for storing viscous products, such as pressed powders and creams.

The Product Palette

Figure 4:
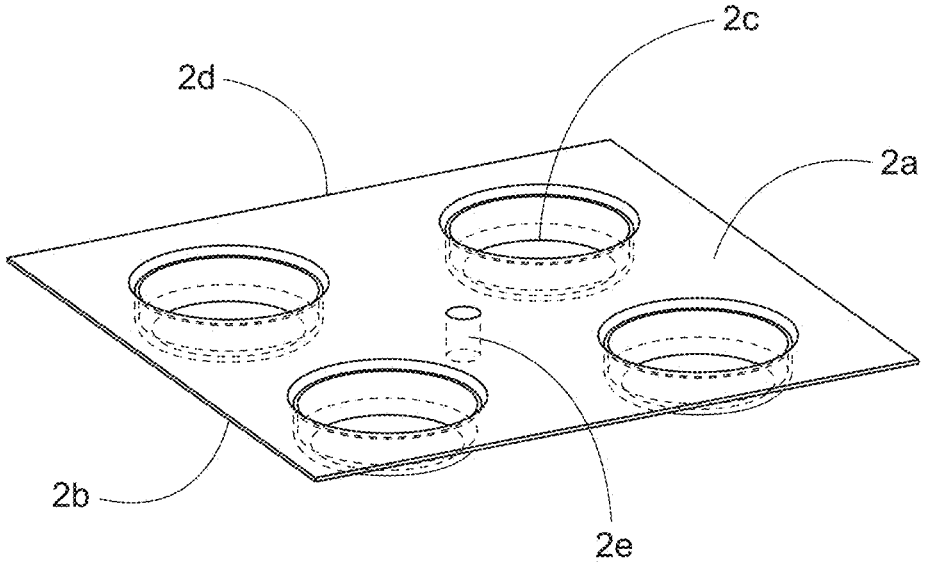
FIG. 4 depicts a product palette with four product wells. The palette is shown as transparent for only to make is easier to visualize.

The product palette (2) described here, replaces the one or more pans or what are commonly called platforms, that are frequently found in compacts. FIG. 4 depicts one embodiment of a product palette according to the present invention. The product palette is sized to be disposed in the interior space (1*c*) of the base (1). The product palette comprises a top surface (2*a*), a bottom surface (2*b*), and one or more product wells (2*c*). The product palette has a perimeter (2*d*). Preferably, the overall shape of the perimeter of the product palette matches the overall shape of the interior space of the base. Preferably, the overall size of the product palette is just slightly smaller then the size of the interior space, so that the product palette has some freedom of lateral movement within the interior space (1*c*) of the base (1). This is unlike conventional compacts wherein the product is disposed in a pan or other compartment that is fixedly attached to the base of the compact. In preferred embodiments, the clearance between the perimeter (2*d*) of the product palette and the inner surface (1*d*) of the lateral wall (1*b*) of the base will be between about 0.1 mm to 10 mm. The base may comprise features that slightly overhang the product palette, so that once the product palette is disposed within the base, it cannot fall out accidentally. For example, a lip or edge (le; see FIG. 2) might slightly overhang the product palette (2). Whatever means is used to retain the product palette in the base, it is important that the product palette has some freedom of lateral movement within the interior space of the base.

Figure 15:
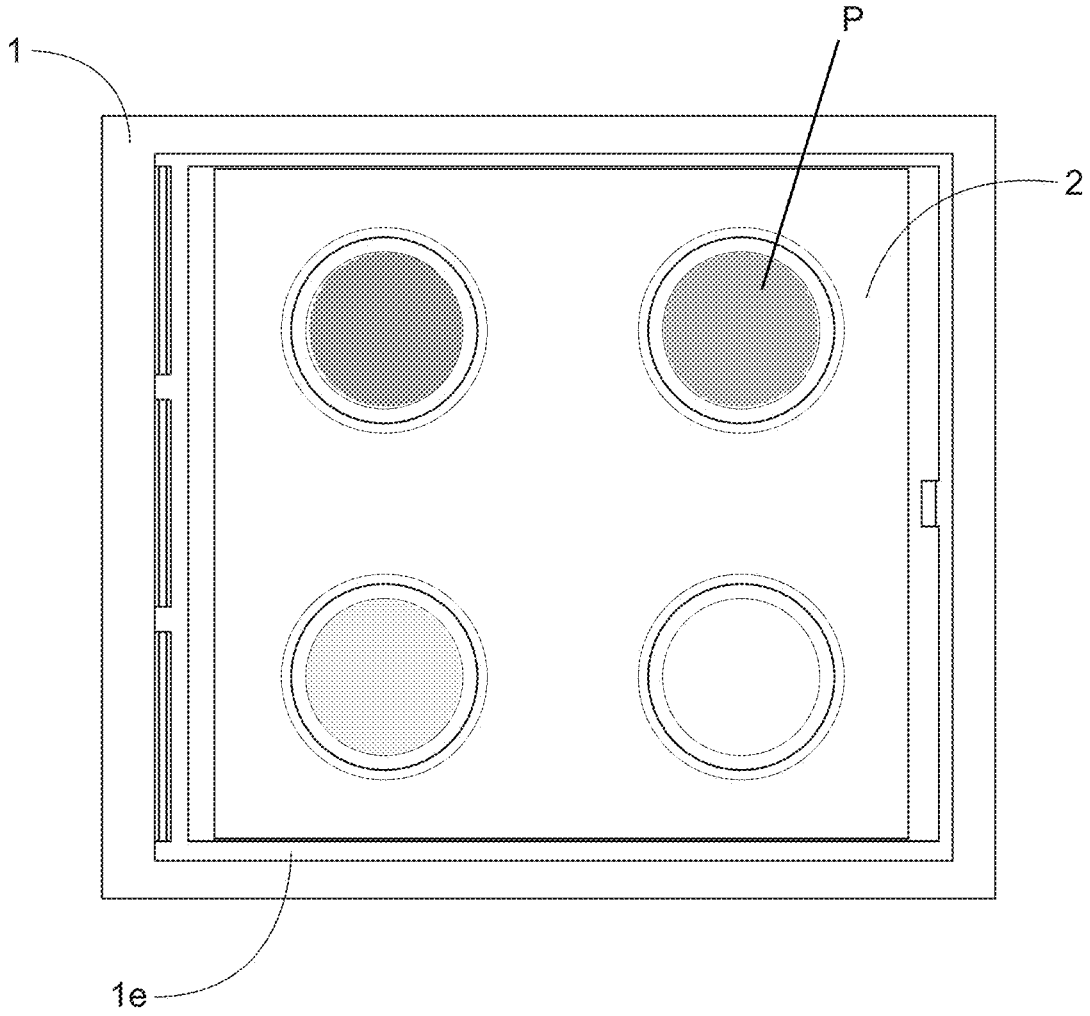
FIG. 15 depicts a product palette disposed in the base of a compact.

The product wells (2*c*) extend downward from the bottom surface (2*b*) of the product palette (2), and are able to receive product (P) to be offered to a consumer. Typically, different wells will house different products, or variations of the same product, such as different shades of the same product. FIG. 15 depicts a product palette with three filled wells (each with a different product) and one empty well. The number of wells is limited by the size of the product palette, and by a need to accommodate the shock absorbing insert (3). In the figures, the product wells are shown as round, but any cross sectional shape may be used as appropriate. Typically, the product palette (2) will be made from plastic by any suitable manufacturing technique, such as injection molding or thermoforming.

The Shock Absorbing Insert

Several embodiments of a shock absorbing insert (3) are shown in FIGS. 5-13. The shock absorbing insert is sized to be disposed in the interior space (1*c*) of the base (1), below the product palette (2), such that the product palette rests on top of, and connects to the shock absorbing insert. The shock absorbing insert is able to exhibit elastic behavior, either through inherent properties of the material or because of the specific geometry of the insert, or both. The shock absorbing inserts are comprised of one or more hubs (3*a*) from which one or more projections extend.

The Hubs

A shock absorbing insert (3) according to the present invention is comprised of one or more hubs (3*a*). When a shock absorbing insert (3) has two or more hubs (see FIG. 12), then adjacent hubs may be joined by a flexible connector (3*h*). In general, one or more projections extend from each hub. Below, we describe two types of projections, one that protects against side impact, and one that protects against bottom impact.

First Type of Projection (Side Impact)

Figure 5:
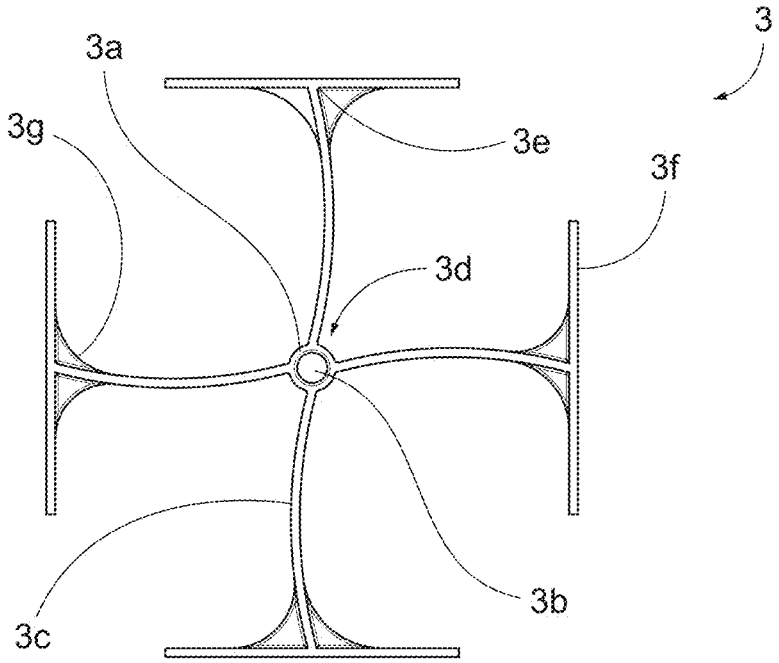
FIG. 5 depicts a shock absorbing insert for with curved legs.
Figure 6:
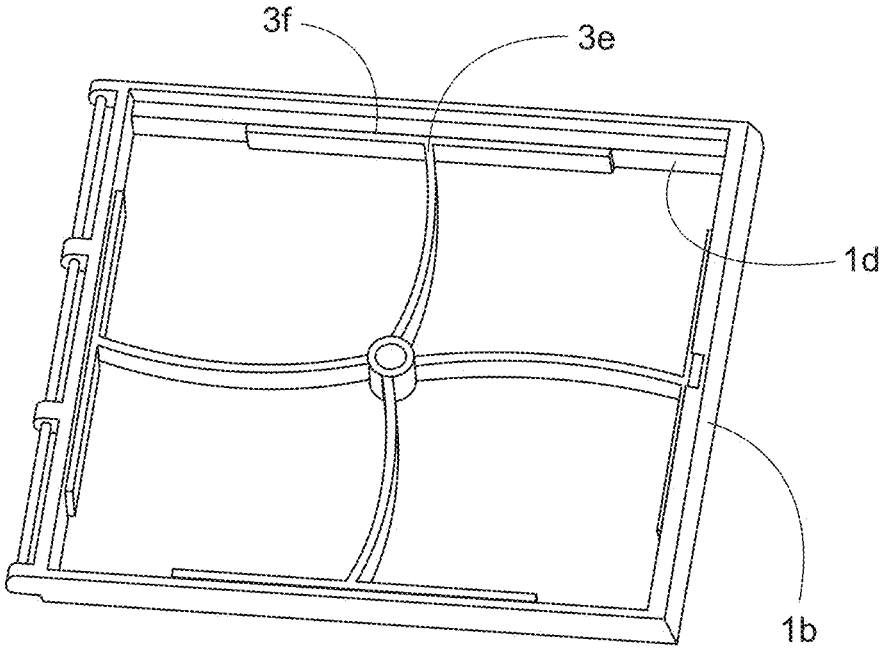
FIG. 6 depicts a hock absorbing insert with curved legs disposed in the base of a compact.
Figure 7:
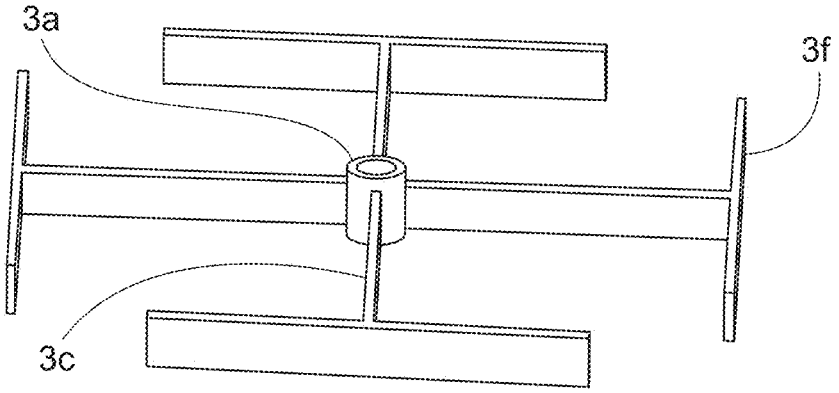
FIG. 7 depicts a shock absorbing insert with straight legs.
Figure 8:
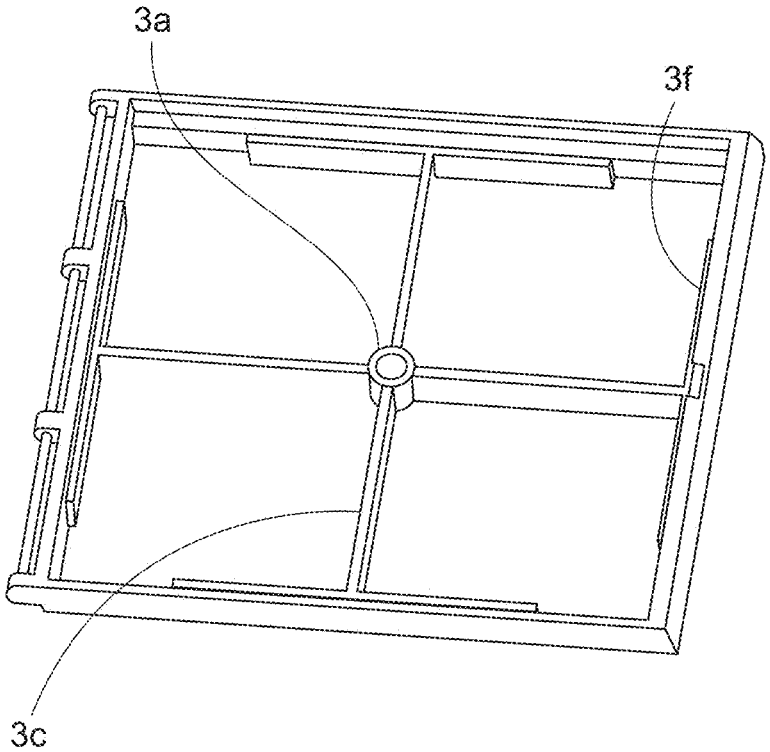
FIG. 8 depicts a hock absorbing insert with straight legs disposed in the base of a compact.

Referring to FIGS. 5 and 6, in a first type of projection, one or more flexible legs (3*c*) extends from one or more hubs (3*a*) of the shock absorbing insert (3). Each leg has a proximal end (3*d*) and a distal end (3*e*). The proximal end is connected to the hub, while the distal end approaches the inner surface (1*d*) of the lateral wall of the base (1). The legs act as flexible compression members whose purpose is to flex or buckle to absorb the force of an impact, especially a lateral impact, and return to their original shape thereafter. The number of legs that extend from each hub may be chosen to maximize the absorption effect, but there will typically be from two to ten legs. Preferably, the legs are spaced approximately equiangularly around a hub. For example, in FIGS. 5, 7, 9 and 11, the shock absorbing inserts comprise one central hub (3*a*) and four legs (3*c*) spaced roughly 90° apart. Or, for example, in a base that has a round interior space, a useful shock absorbing insert (3) may have three legs spaced about 120° apart.

In discussing the overall shape of a leg (3*c*), we talk about the shape of a leg along its length, and its cross-sectional shape. Regarding the cross-sectional shape of each leg, the figures depict a rectangular cross-section having constant width and constant height. But this feature is not absolutely necessary, and other cross-sectional shapes will be useful. Regarding the shape of each leg along its length, the simplest embodiment is straight leg (see FIGS. 7-8). However, it is also conceivable that an unlimited number of differently shaped legs may be effective to absorb the energy of impact. Preferably, the legs are curvilinear along their length, as curvilinear legs are expected to flex and/or compress more easily, and absorb more shock than straight legs. Also, each leg may not be identical, especially when the geometry of the interior space is not regular.

Figure 9:
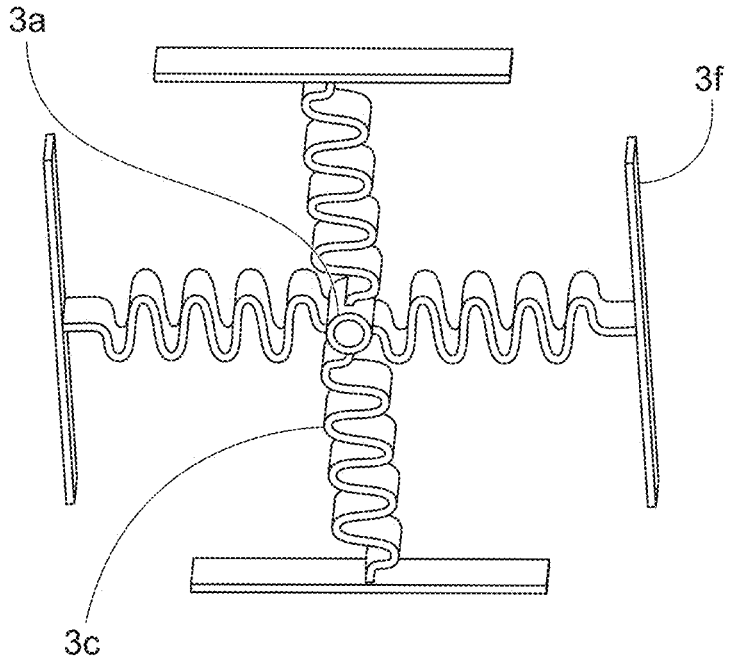
FIG. 9 depicts a shock absorbing insert for with sinusoidal legs.
Figure 10:
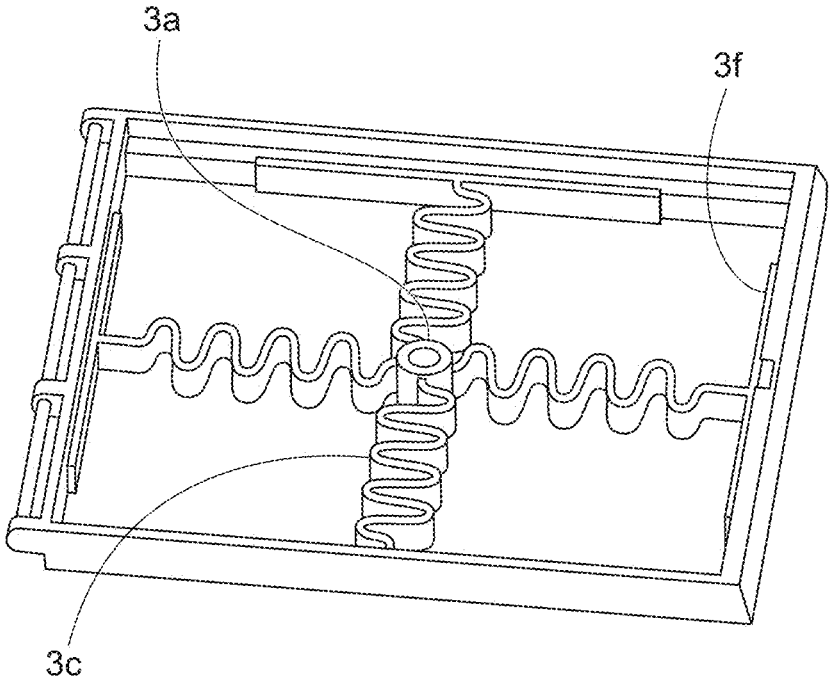
FIG. 10 depicts a hock absorbing insert with sinusoidal legs disposed in the base of a compact.
Figure 11:
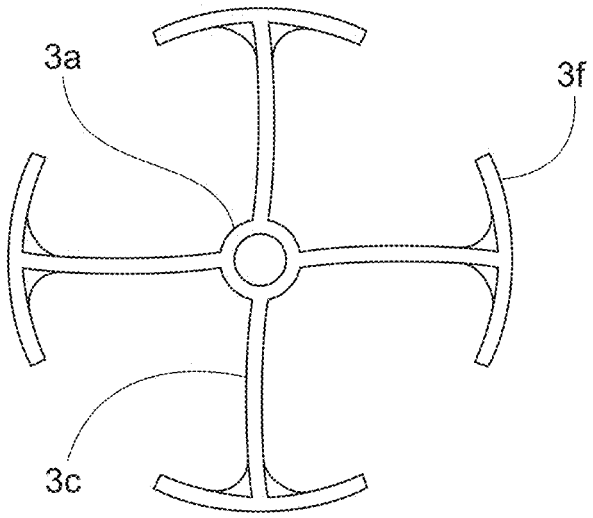
FIG. 11 depicts a shock absorbing insert suitable for a round compact.
Figure 12:
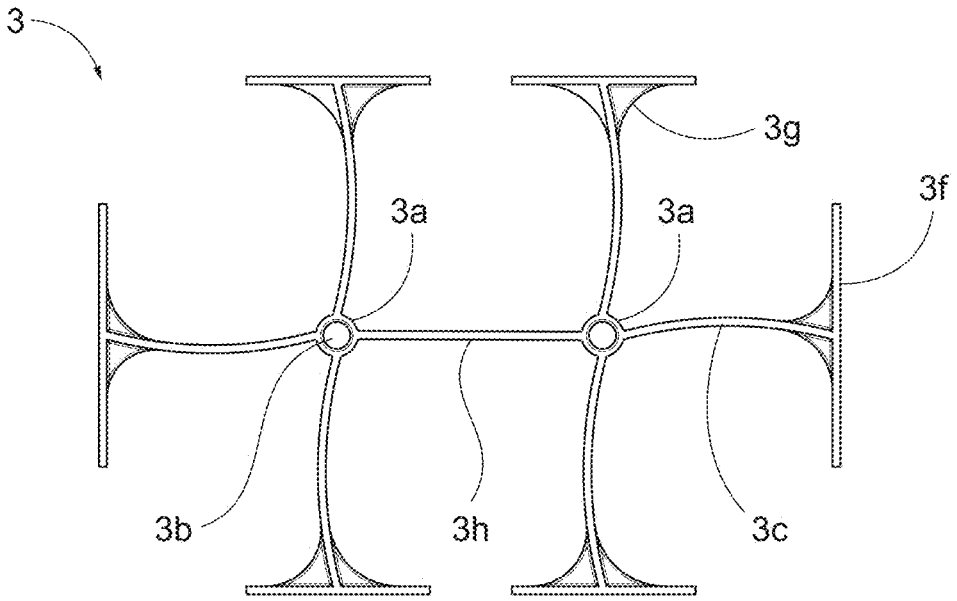
FIG. 12 depicts a shock absorbing insert suitable or a rectangular compact.

Particularly useful are flexible legs whose shape is sinusoidal along their length. For example, each leg shown in FIG. 9 is sinusoidal with four complete cycles, while each leg shown in FIG. 5 is one-half cycle of a sine wave. In practical terms, the number of cycles in a sinusoidal leg may vary from about one-half to about twenty. Also to be considered is the amplitude of the sine wave. In general, the greater the amplitude, the more easily the legs will compress. We also contemplate that the amplitude within a leg may not be constant. For any particular application, the desired number of cycles in each leg and the amplitude of each cycle may be determined by trial and error. Analogous to the sinusoidal flexible legs are saw-toothed flexible legs, which are also useful.

At the distal end (3*c*) of each leg (3*c*), a foot (3*f*) is located. Preferably, each leg and foot meet at an approximately 90° angle. Each foot has a length that lies immediately adjacent to the inner surface (1*d*, 1*d*') of the lateral wall (1*b*, 1*b*') of the base (1). In their rest position, the feet may be straight or curved (as in FIG. 11) to conform to the shape of the inner surface of the lateral wall. In some embodiments, each foot of the shock absorbing insert (3) maintains constant contact with the inner surface of the lateral wall such that there is some pre-loading or compression in the legs (3*c*). The amount of pre-loading should be kept small, so that the legs may absorb the maximum amount of energy on impact. Alternatively, in preferred embodiments, the shock absorbing insert (3) is very slightly smaller than the interior space defined by the inner surface of the lateral wall, such that there is no pre-loading in the legs. In either case, during an impact event, the compression of the base will enhance the contact between the inner surface of the lateral wall and the feet of the shock absorbing insert. The contact will be sufficient to transmit much of the energy of impact to the feet of the shock absorbing insert.

Optionally, one or more struts (3*g*) may be provided at the point of contact between a leg and a foot (see FIG. 5). The strut helps the foot to maintain its orientation with respect to the inner surface (1*d*) of the lateral wall (1*b*) of the base (1), by countering any tendency of the shock absorbing insert (3) to rotate out of position during impact.

The cross sectional shape of the legs (3*c*) and feet (3*f*) will typically be uniform, but may vary. In terms of material and density, the cross section of the legs and feet may be uniformly solid, and made from plastic by any suitable manufacturing technique, such as injection molding or thermoforming. Alternatively where more sophisticated manufacturing methods are used (like additive manufacturing), then the legs and feet may have an internal structure that is designed to absorb energy and dissipate it away from the product palette (2).

A shock wave from an impact that causes deformation of the inner surface (1*d*) of the lateral wall (1*b*) will first be transmitted to the foot (3*f*) closest to the impact site. The energy of the impact will be transmitted though the associated leg (3*c*) and to the rest of the shock absorbing insert (3). The flexible legs collapse and stretch. In the process, a substantial portion of the impact energy is absorbed and dissipated before it can reach the product in the wells (2*c*).

The Projections-Second Type

Figure 13:
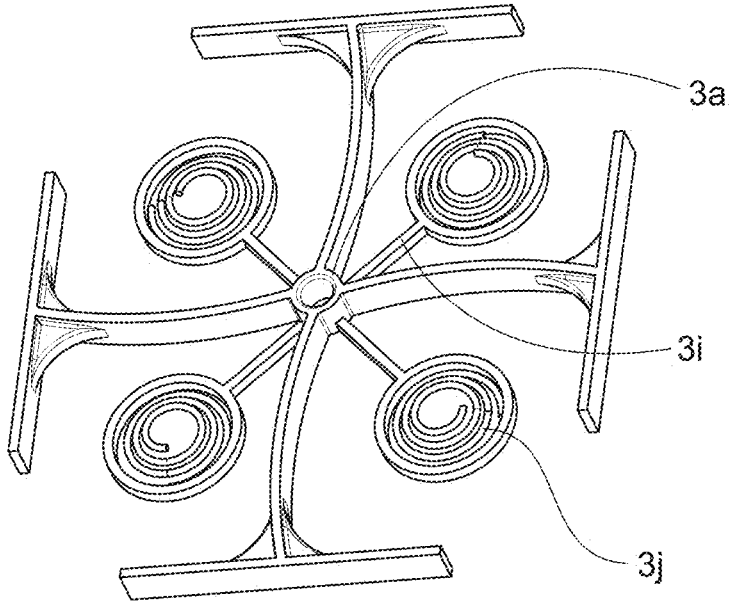
FIG. 13 depicts a shock absorbing insert designed to mitigate bottom impact.

Referring to FIG. 13, in a second type of projection, one or more arms (3*i*) extend from one or more hubs (3*a*) of the shock absorbing insert (3). Each arm has a proximal end attached to the hub, and a distal end away from the hub. The arms may be rigid or flexible, but unlike the legs (3*c*), the purpose of the arms is not to act as compression members. Rather, some or each of the arms accommodate one or more compression springs (3*j*). Each of the one or more compression springs is associated with one arm, such that when the shock absorbing insert is disposed in the interior space (1*c*) of a base (1), the position of each compression spring is fixed relative to the closed bottom (1*a*) of the base. Compression springs are open-coiled helical springs designed to resist a compressive force applied axially. Preferred, are conical compression springs, which assume a minimum height when fully compressed.

As noted, the position of each compression spring is fixed by its associated arm (3*i*), relative to the closed bottom (1*a*) of the base. For example, a compression spring may be physically attached to some portion of its associated arm (3*i*), such as the distal end of the arm, of the shock absorbing insert (3). This can be achieved by an interference fit, adhesive, integrally molding the arm and the associated compression spring as a unitary component, or any other known means. Alternatively, a compression spring may be disposed in a fitting (3*m*) that confines the lateral movement of the spring while the spring itself remains physically detached from the associated arm. For example, in FIG. 13, the distal end of each arm (3*i*) is formed as a ring (3*m*) into which an associated compression spring may be disposed.

The compression springs (3*j*) are oriented vertically, so that the bottom end (3*k*) of each spring will rest on (or be supported by) the closed bottom (1*a*) of the base (1). At the same time, the top end (31) of each spring lightly contacts, or nearly contacts, the bottom surface (2*b*) of the product palette (2). The number of arms that extend from each hub may be chosen to maximize the absorption effect of the springs. A shock wave from an impact that causes deformation of the closed bottom (1*a*) of the base (1) will be mitigated by the compression springs (3*j*) of the shock absorbing insert (3).

A shock absorbing insert (3) may have projections of the first type (legs and feet) or projections of the second type (arms and springs) or both (as in FIG. 13). The first type of projections will be more effective at mitigating the effects of impact to the lateral wall (1*b*) of the compact (10). The second type of projections will be more effective at mitigating the effects of impact to the closed bottom (1*a*) of the base (1).

Figure 14:
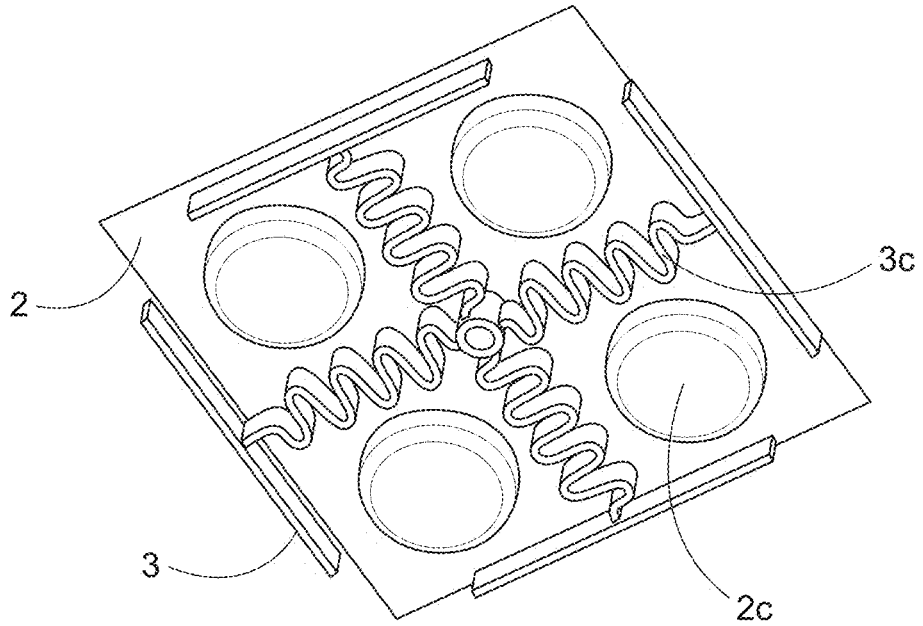
FIG. 14 shows the positional relationship of a product platform and shock absorbing insert.

Regardless of the type of projection, it is important that the hubs (3*a*) of the shock absorbing insert (3) maintain a physical connection to the product palette (2). The physical connection will ensure that all or most energy of impact is not transferred into the product palette. At the same time, the connection between the hubs of the shock absorbing insert and the product palette do not hinder the flexible legs (3*c*) from absorbing the force of an impact and returning to their original shape thereafter. The connection between the hubs of the shock absorbing insert and the product palette may be achieved by various known means, such as an interference fit, sonic welding, adhesive, heat staking, chemical bonding, etc. One non-limiting example of an interference fit is described here, and shown in the drawings. The bottom surface (2*b*) of the product palette (2) may be provided with one or more extensions (2*e*) that extend downward below the product palette. For example, in FIG. 4, the extension is shown as an insertion pin (2*e*) that extends downward, below the product palette. Also, one or more of the hubs will have a channel (3*b*) for receiving one pin of the product palette. The fit of each pin into a channel must be a precision fit, sufficiently snug to ensure that there is little or no relative movement between the pin of the product palette and the hub of the shock absorbing insert. This will ensure that all or most energy of impact is not transferred into the product palette. The placement of each pin into a channel also ensures the correct positioning of the product palette over the shock absorbing insert. In some embodiments, the pins reach to a depth that is no more than the depth of the product wells (2*c*). In other embodiments, the pins may be longer. In some embodiments of the present invention, the product wells (2*c*) of the product palette (2) are placed in between the legs (3*c*) and/or arms (3*i*) of the shock absorbing insert (3) (see FIG. 14). In other embodiments, the entire product palette, including the product wells sit above the shock absorbing insert.

As has been discussed, the product palette (2) and shock absorbing insert (3) are not fixedly attached to the base of the compact. This means that a combination of product palette and shock absorbing insert may be designed for use in an existing compact without having to modify the base of the existing compact. A combination of the product palette and shock absorbing insert, properly sized, can simply be dropped into the existing base. Furthermore, the relatively simple design of product palette and shock absorbing insert means that these parts can be mass produced by conventional, high volume injection molding at relatively low cost.

What is claimed is:

1. A compact case comprising: a base, a shock absorbing insert and a product palette, wherein:
- the base comprises:
  - a closed bottom;
  - a lateral wall having an inner surface; and
  - an interior space defined by the closed bottom and the inner surface;
- the shock absorbing insert comprises:
  - one or more hubs;
  - a plurality of flexible legs, each flexible leg having:
    - a proximal end connected to each of the one or more hubs, and
    - a distal end that approaches the inner surface of the base or is connected to another hub;
  - a foot located at the distal end of each flexible leg, such that each foot lies adjacent to the inner surface;
- the product palette is connected to the one or more hubs of the shock absorbing insert, and comprises:
  - a top surface;
  - a bottom surface, and
  - one or more product wells that extend downward from the bottom surface of the product palette; and wherein,
- the product palette rests on top of the shock absorbing insert, such that the one or more product wells are located in between the plurality of flexible legs of the shock absorbing insert; and
- both the product palette and shock absorbing insert are located in the interior space of the base, and not fixedly attached to the base.

2. The compact case of claim 1 wherein the plurality of flexible legs are straight or curvilinear.

3. The compact case of claim 2 wherein the plurality of flexible legs are sinusoidal.

4. The compact case of claim 1 wherein:
- each hub comprises a channel; and
- the bottom surface of the product palette comprises at least one extension wherein each of the at least one extension extends downward into the channel of a respective one of the at least one hub.

5. The compact case of claim 1 wherein:
- the product palette has a perimeter such that a clearance of 0.1 mm to 10 mm exists between the perimeter of the product palette and the inner surface of the base.

6. The compact case of claim 1 wherein the shock absorbing insert further comprises:
- a plurality of arms attached to the one or more hubs, and
- a plurality of vertically oriented compression springs, wherein each compression spring is associated with one of the arms, such that the position of each compression spring is fixed by its associated arm, relative to the closed bottom of the base.

7. A compact case comprising a base, a shock absorbing insert and a product palette, wherein:

the base comprises:

a closed bottom;

a lateral wall having an inner surface; and an interior space defined by the closed bottom and the inner surface;

the shock absorbing insert comprises:

one or more hubs;

a plurality of arms attached to the one or more hubs, and a plurality of vertically oriented compression springs, wherein each compression spring is associated with one of the arms;

a plurality of flexible legs, each flexible leg having:

a proximal end connected to each of the one or more hubs, and a distal end that approaches the inner surface of the base or is connected to another hub;

a foot located at the distal end of each flexible leg, such that each foot lies adjacent to the inner surface;

the product palette is connected to the one or more hubs of the shock absorbing insert, and comprises:

a top surface;

a bottom surface, and one or more product wells that extend downward from the bottom surface of the product palette; and wherein, the product palette rests on top of the shock absorbing insert, such that the one or more product wells are located in between the plurality of flexible legs of the shock absorbing insert; and both the product palette and shock absorbing insert are located in the interior space of the base, and not fixedly attached to the base.

8. The compact case of claim 7 wherein:

each hub comprises a channel; and the bottom surface of the product palette comprises at least one extension wherein each of the at least one extension extends downward into the channel of a respective one of the at least one hub.

9. The compact case of claim 7 wherein:

the product palette has a perimeter such that a clearance of 0.1 mm to 10 mm exists between the perimeter of the product palette and the inner surface of the lateral wall of the base.

* * * * *